US005524580A

United States Patent [19]

Muir

[11] Patent Number: 5,524,580

[45] Date of Patent: Jun. 11, 1996

[54] ADJUSTING MECHANISM FOR A VALVE CONTROL SYSTEM

[75] Inventor: Darryl J. Muir, Bellevue, Mich.

[73] Assignee: Eaton Corporation, Cleveland, Ohio

[21] Appl. No.: 439,531

[22] Filed: May 11, 1995

[51] Int. Cl.[6] ..... F01L 1/18; F01L 13/00; F02D 13/06; G05G 1/04

[52] U.S. Cl. ..... 123/90.16; 123/90.44; 123/198 F; 74/519; 74/559

[58] Field of Search ..... 123/90.15, 90.16, 123/90.17, 90.27, 90.32, 90.39, 90.41, 90.43, 90.45, 90.46, 198 F; 74/519, 559

[56] References Cited

U.S. PATENT DOCUMENTS

| | | | |
|---|---|---|---|
| 4,151,817 | 5/1979 | Mueller | 123/90.16 |
| 4,556,025 | 12/1985 | Morita | 123/90.16 |
| 4,567,861 | 2/1986 | Hara et al. | 123/90.16 |
| 4,611,558 | 9/1986 | Yoshizaki et al. | 123/90.16 |
| 4,768,467 | 9/1988 | Yamada et al. | 123/90.16 |
| 4,844,023 | 7/1989 | Konno et al. | 123/90.44 |
| 5,107,803 | 4/1992 | Furnivall | 123/90.16 |
| 5,113,813 | 5/1992 | Rosa | 123/90.16 |
| 5,183,015 | 2/1993 | Morita et al. | 123/90.39 |

FOREIGN PATENT DOCUMENTS

| | | | |
|---|---|---|---|
| 4118287 | 12/1992 | Germany | 123/90.16 |
| 168211 | 9/1984 | Japan | 123/90.16 |

*Primary Examiner*—Weilun Lo
*Attorney, Agent, or Firm*—Frank M. Sajovec

[57] ABSTRACT

An adjusting mechanism for a valve control system of the type which includes a first rocker arm engageable with a poppet valve, a second rocker arm mounted for pivotal movement relative to the first rocker arm and engageable with a cam lobe, means for selectively interconnecting the rocker arms, and means biasing the first rocker arm into engagement with the valve and the second rocker arm into engagement with the cam lobe, wherein the adjusting mechanism limits the extent of relative pivoted movement between the rocker arms. In a preferred embodiment the biasing means is a compression spring acting between the first and second rocker arms and the adjusting mechanism includes a threaded member coaxial with the spring and acting on the arms to control the spacing of the arms along the axis of the spring.

17 Claims, 3 Drawing Sheets

ADJUSTING MECHANISM FOR A VALVE CONTROL SYSTEM

The present invention relates to a system for varying the operational characteristics of intake or exhaust valves in an internal combustion engine during various operational modes of the engine and more particularly to an adjustment mechanism for such system.

Variable valve control systems for multiple valve engines wherein the intake and/or exhaust valves can either be selectively actuated and deactuated or actuated at selected lift profiles, are well known in the art.

One known system is shown in U.S. Pat. No. 4,151,817, which discloses a primary rocker arm element engageable with a first cam profile, a secondary rocker arm element engageable with a second cam profile, and means to interconnect or latch the primary and secondary rocker arm elements.

U.S. patent application Ser. No. 412,474 filed Mar. 28, 1995, which is incorporated herein by reference, discloses a system of the above type which is specifically operable to selectively actuate or deactuate an engine valve and which comprises a latchable rocker arm assembly including an inner rocker arm having a roller which contacts the cam; an outer rocker arm which engages the valve, the inner and outer arms being in nesting relation to one another and in pivotal contact with a pivot point on the cylinder head of the engine, which pivot point can be the output plunger of a stationary lash adjuster; and a sliding latch member which is moveable between an active position wherein the inner and outer arms are effectively latched together and operable to actuate the valve, and an inactive position wherein the inner and outer arms are free to move relative to one another and the valve is not actuated. The assembly further includes a biasing spring acting between the inner and outer arms to bias the inner arm into engagement with the cam and the outer arm into engagement with the valve, the relationship between the inner and outer arms being effective to counteract the plunger spring and hydraulic forces of the lash adjuster to insure that the lash adjuster does not pump up when the rocker arms are in their unlatched condition.

In the above system, lash at the point of engagement of the latch member with the inner and outer rocker arms is maintained by closely controlling the dimensioning and tolerances among the inner and outer rocker arms and the sliding latch member. A certain amount of lash is necessary to provide smooth engagement and disengagement at low actuating force levels. While an optimum initial lash setting can be obtained by careful dimensioning and tolerance maintenance, the manufacturing precision required can be cost prohibitive.

The present invention provides means to adjust the relative angular positions of the inner and outer rocker arms in the above structure at assembly so that the optimum lash at the engagement interfaces of the assembly can be set without relying on precise dimensioning and extremely close machining tolerances. In accordance with the invention, adjustment is effected by means of a threaded fastener which limits the maximum separation of the inner and outer rocker arms at the point of engagement of the biasing spring with the inner and outer arms.

Other objects and advantages of the invention will be apparent from the following description when considered in connection with the accompanying drawings, wherein.

Figure 2:
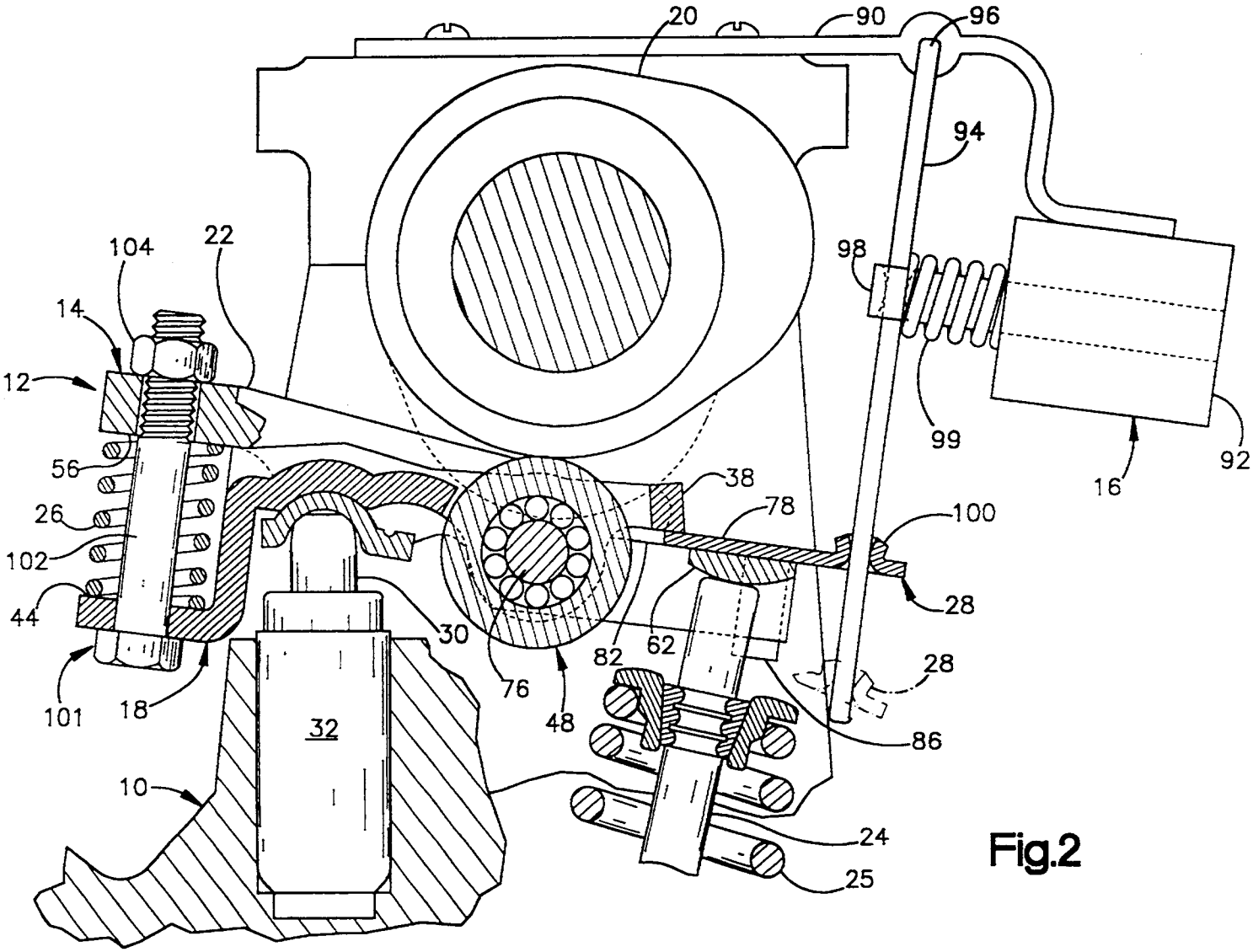
FIG. 2 is a sectional view taken along line 2–2 of FIG. 1.

Referring primarily to FIG. 2, there is illustrated a portion of the cylinder head 10 of an internal combustion engine of the overhead cam type which incorporates the valve control system 12, of the invention. As Illustrated herein, the control system 12 is of the type which is particularly adapted to selectively actuate or deactuate an engine valve and comprises a rocker arm assembly 14 which is shiftable between an active mode wherein it is operable to open the valve, and an inactive mode wherein the valve is not opened; and an actuator assembly 16 which is operable to shift the rocker arm assembly between its active and inactive modes.

The rocker arm assembly 14 comprises an inner arm assembly 18 which is engageable with the valve actuating cam 20 of the engine, an outer arm 22 which is engageable with a poppet valve 24 which is maintained normally closed by a spring 25, a biasing spring 26 which acts between the inner and outer arms to bias the inner arm into engagement with the cam 20 and the outer arm into engagement with the plunger 30 of a stationary lash adjuster 32, and a latch member 28 which is slidably received on the outer arm and which is effective to latch the inner and outer arms together to define the active mode of the control system or to unlatch them to define the inactive mode. In the preferred embodiment of the invention the outer arm 22 is pivotally mounted on the plunger 30 and the inner arm 18 is pivotally mounted on the outer arm 22. The construction and the function of the lash adjuster 32 are well known and will not be described in detail herein. It will also be apparent that the rocker arm assembly can be mounted on a fixed pivot point or lash adjustment means other than a hydraulic lash adjuster.

To provide a better understanding of the relationship between the inner and outer rocker arms, reference is made to the details of these components in FIGS. 3–6.

Figure 3:
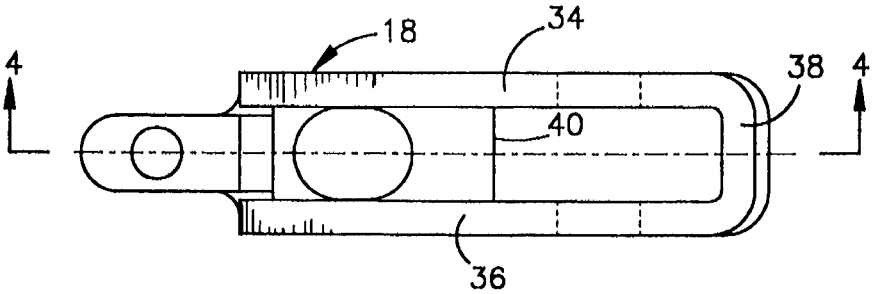
FIG. 3 is a plan view of a first rocker arm of the invention.
Figure 4:
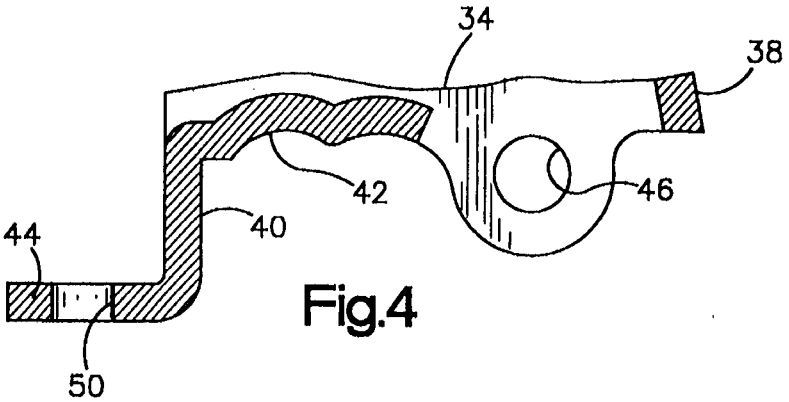
FIG. 4 is a section view taken along line 4–4 of FIG. 3.

Referring to FIGS. 3 and 4, the inner arm 18 is preferably a stamped structure which is generally U-shaped in plan, having spaced apart wall sections 34 and 36, a contact element 38 at the base of the U, and a central spine section 40. The spine section 40 defines the pivot point of the arm in the form of a socket portion 42 which contacts the outer arm as will be described below, and a spring receiving element 44. Aligned bores 46 are formed in the walls 34 and 36 to receive the axle of a needle roller assembly 48 (see FIG. 2). A hole 50 is formed in the element 44 to receive the adjusting assembly, as will be described below. As will be described in more detail below, the contact element 38 defines a latch surface which interacts with the outer arm 22 and the latch member 28.

Figure 5:
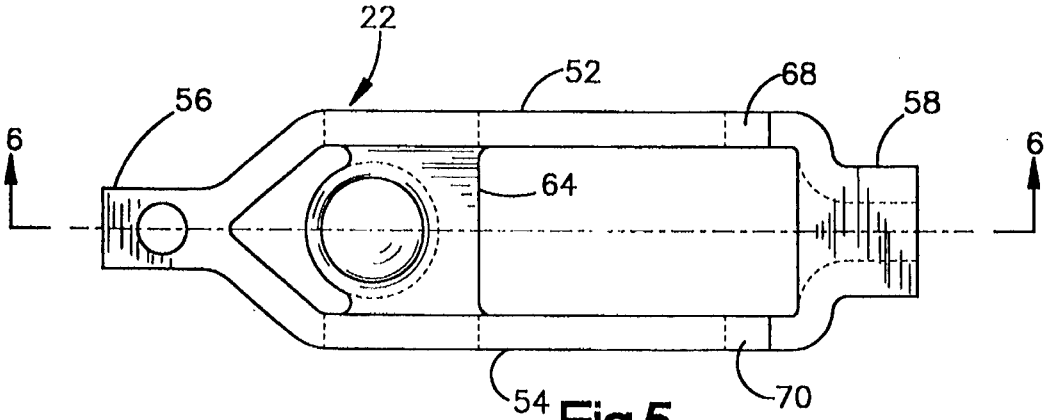
FIG. 5 is a plan view of a second rocker arm of the invention.
Figure 6:
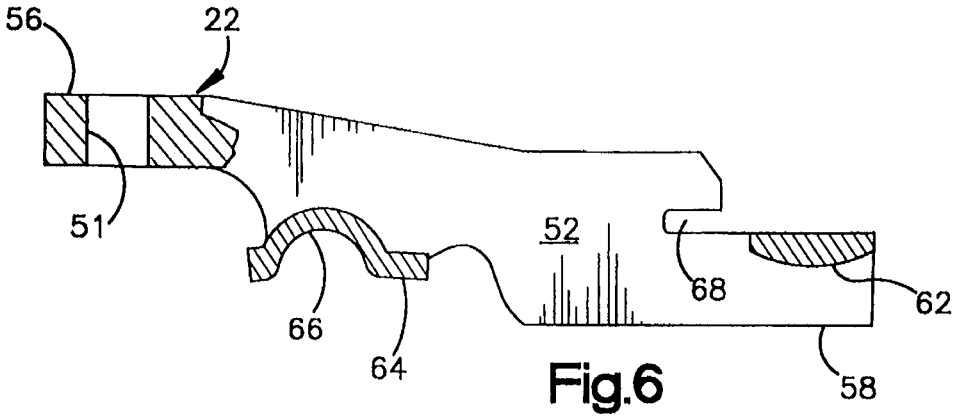
FIG. 6 is a section view taken along line 6–6 of FIG. 5.

Referring to FIGS. 5 and 6, the outer arm 22 is a generally rectangular member in plan view having spaced apart side walls 53 and 54 and converging end portions 56 and 58, the end portion 56 defining a spring receiving element, and the end portion 58 defining a valve contacting pad 62. A web element 64 is formed between the walls 52 and 54 and defines a socket portion 66 which is received between the socket portion 42 of the inner arm and the lash adjuster plunger 30 when the arms are assembled. The walls 52 and 54 are slotted at 68 and 70 to receive the latch member 28. A hole 51 is formed in the end portion 56 to receive the adjusting assembly, as will be described below.

Referring again to FIG. 2, at assembly the inner and outer arms are nested together with the spine section 40 of the inner arm 18 received over the web element 64 of the outer arm 22. The needle roller assembly 48 is received between the walls 34, 36 of the inner arm with the roller axle having a slip fit within the bores 46. With the inner arm being received between the walls 52, 54 of the outer arm, the axle 76 is always in contact with the walls during operation such that no positive retention means such as staking is required to retain the needle roller assembly.

When the assembled rocker arms are installed in the engine, the socket portion 66 of the outer arm 22 is positioned over the plunger 30 of the lash adjuster 32, which places the roller assembly 48 of the inner arm 18 in contact with the cam 20 and the contact pad 62 of the outer arm 22 in contact with the valve 24. When the spring 26 is positioned over the elements 44 and 56 between the inner and outer arms, the inner arm 18 is biased into engagement with the cam 20 (via the roller 48) and the outer arm 22 is biased into engagement with the valve 24 and with the plunger 30, the angular position of the rocker arm assembly 14 about the longitudinal axis of the lash adjuster being maintained by the end of the stem of valve 24 being trapped between the walls of the converging end portion 58 of the outer arm 22.

Figure 1:
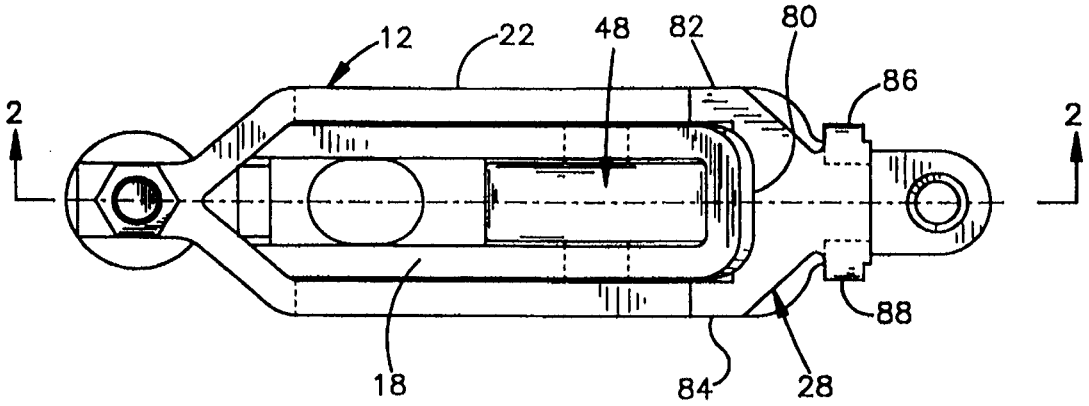
FIG. 1 is a partial plan view of the invention.

The control system 12 is shifted between its active and inactive modes by means of the latch member 28. In the embodiment shown, the latch is in the form of a plate which is mounted on the outer arm 22 and is engageable with the contact element 38 of the inner arm. The latch member 28 comprises a flat plate element 78 which slides along the top surface of the outer arm and which has a central region 80 which is engageable with the contact element 38 of the inner arm, and a pair of axially extending finger elements 82 and 84 which straddle the inner arm and are receivable within the slots 68 and 70 of the outer arm. The latch member is biased into its latched position and it is maintained in position on the outer arm by means of tabs 86 and 88 which partly surround the end 58 of the outer arm. As illustrated in FIGS. 1 and 2, the latch member is shown in its active or engaged position with the central region 80 engaged by the inner arm. In this position, when the cam 20 rotates through the broken line position of FIG. 2, the force of the cam 20 on the roller 48 is transmitted to the outer arm 22 through the latch 28 and to the valve 24, moving the valve to its open position.

To shift the assembly from its active mode to its inactive mode, the latch member 28 is moved to the right as illustrated in FIG. 2 by means of actuator assembly 16 to slide the latch member out of engagement with the inner arm. With the latch disengaged, the force of the cam against the inner arm is transmitted to the spring 26 rather than to the outer arm, and the valve remains in its closed position.

In the illustrated embodiment, the actuator assembly is shown somewhat schematically since a variety of linear actuating arrangements can be used to shift the latch member 28, and the actual arrangement employed will depend on space and mounting limitations associated with a particular engine in which the system is installed. As shown herein, the assembly comprises a bracket member 90 suitably attached to the engine, a solenoid 92 attached to the bracket, an actuating rod 94 which is pivotally mounted to the bracket at 96 and which is slidingly received within the latch member 28 and engaged by the output member 98 of the solenoid, and a compression spring 99 which acts between the solenoid 92 and the rod 94 to bias the latch member into a normally engaged position. To accommodate movement of the valve, the rod 96 is received through a spherical socket element formed on the latch member, permitting the latch member to slide along the rod in moving between the valve closed position shown in the full line and the valve open position shown in broken line without undue lash between the actuator and the latch.

Referring to FIG. 2, in accordance with the invention, an adjustment assembly, designated 101, permits the precise setting of the maximum clearance between the contact element 38 of the inner arm 18 and the central region 80 of the latch member 28 prior to installing the system is an engine, thus avoiding the need for extremely precise dimensioning and tolerancing of these components.

The adjustment assembly comprises a bolt 102 received through the spring receiving elements 44 and 56 of the inner and outer rocker arms 18 and 22, respectively, and a nut 104 which is threaded onto the bolt and which bears against the outer arm, the bolt 102 also serving to center the spring 26. The bolt can be fixed to the arm 18. At assembly, the position of the nut 104 on the bolt 102 is adjusted, causing the inner and outer arms to pivot relative to one another and changing the spacing between the element 38 and the plate 78, until an optimum clearance is obtained. In the preferred embodiment, the minimum clearance which permits free movement of the latch member 28, also allowing for wear within the system, is considered optimum. In the unlatched mode of the system, the adjustment assembly acts as a positive stop limiting leakdown of the lash adjuster 32 caused by the load of the biasing spring 26 against the plunger 30.

Figure 7:
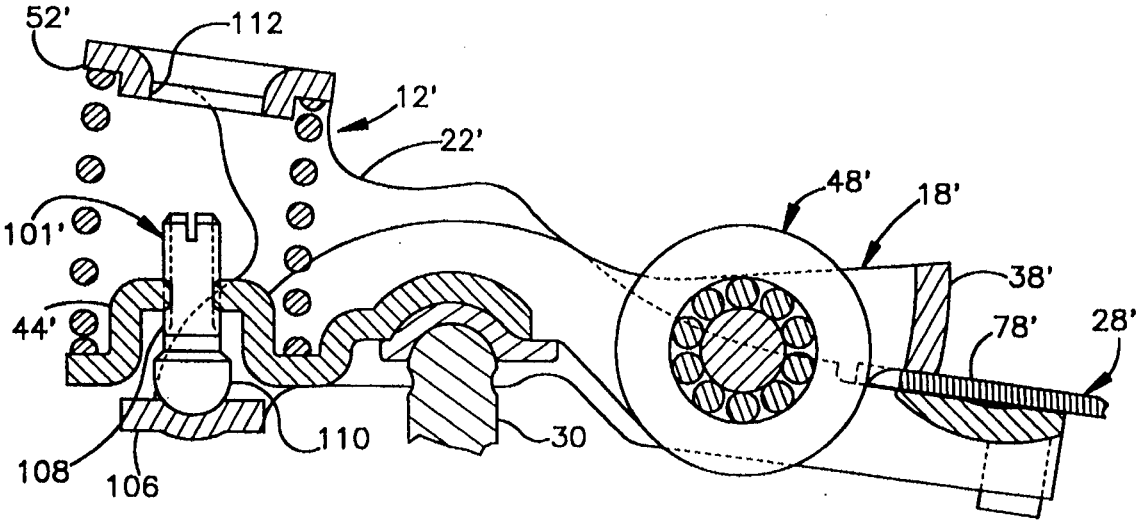
FIG. 7 is a sectional view showing another embodiment of the invention.

Referring to FIG. 7, there is illustrated another embodiment of the invention. This embodiment comprises an inner arm assembly 18' which includes a roller assembly 48' and a contact element 38', which is similar to that shown in FIGS. 1–6; and an outer arm 22' which includes a spring receiving element 56' as in the first embodiment but which also includes a plate element 106 which projects beneath the spring receiving element 44' of the inner arm in position to contact a stop/adjusting screw 108. The screw 108 is threaded into the spring receiving element and includes a ball end 110 which is engageable with a corresponding socket formed in the projection 106. To maintain its position, the screw can be a self-locking type, or a lock nut can be added.

The screw 108 is accessible through a hole 112 formed in inner arm, and prior to assembly of the system in an engine, is used to set the initial lash at the interface of the contact element 38' and the plate element 78' of the latch member 28'. The engagement of the projection 106 of the inner arm with the screw 108 also acts as a positive stop, as in the above embodiment.

I claim:

1. In a valve control system for an internal combustion engine including a cylinder head, a poppet valve, and a camshaft having a cam lobe formed thereon; said control system comprising a first rocker arm engageable with said poppet valve; a second rocker arm engageable with said cam lobe, said first and second rocker arms being mounted on said cylinder head for pivotal movement relative to said cylinder head and relative to one another; means biasing said first rocker arm into engagement with said poppet valve and said second rocker arm into engagement with said cam lobe; and means for selectively interconnecting said first and second rocker arms for rotation in unison in response to a force applied by said cam lobe to said second rocker arm; the improvement comprising means adjustably limiting the extent of the relative pivotal movement between said first and second rocker arms.

2. Apparatus as claimed in claim 1, in which said means biasing said first rocker arm into engagement with said poppet valve and said second rocker arm into engagement with said cam lobe comprises a spring acting between said first and second rocker arms.

3. Apparatus as claimed in claim 2, in which said first rocker arm comprises a first elongated arm member having a valve contacting element thereon and a first spring receiving surface formed thereon axially spaced from said valve contacting element; said second rocker arm comprises a second elongated arm having a cam contacting element thereon and a second spring receiving surface formed thereon axially spaced from said cam contacting element; and means pivotally mounting said first arm member relative to said second arm member about an axis between the valve contacting element and the first spring receiving surface of said first arm and between the cam contacting element and the second spring receiving element of said second arm, said spring comprising a compression spring received between said first and second spring receiving surfaces.

4. Apparatus as claimed in claim 3, in which the means adjustably limiting the extent of relative pivotal movement between said first and second rocker arms comprises means for controlling the spacing between said first spring receiving surface and said second spring receiving surface.

5. Apparatus as claimed in claim 4, in which said means for controlling the spacing between said first and second spring receiving surfaces comprises a threaded member acting on said first and second arms coaxially with said compression spring.

6. Apparatus as claimed in claim 5, in which said threaded member comprises a bolt received through said first and second arms with its head engaged with one of said arms and including a nut threaded onto said bolt and engaged with the other of said arms.

7. Apparatus as claimed in claim 4, in which said first and second arm members are pivotally mounted relative to one another to define a scissors assembly with the portion of said first arm member including said valve contacting element and the portion of said second arm member including said cam contacting element defining a first pair of adjacent legs of said scissors assembly and the portion of said first arm member including said first spring receiving surface and the portion of said second arm member including said second spring receiving surface defining a second pair of adjacent legs of said scissors assembly.

8. Apparatus as claimed in claim 7, in which said second pair of adjacent legs is formed with a portion of said first arm member being formed with a projection extending outward of said second arm member opposite said second spring receiving surface, said means for controlling the spacing between said first and second spring receiving surfaces comprising means acting between said second arm member and said projection.

9. Apparatus as claimed in claim 8, in which said means acting between said second arm member and said projection comprises a threaded member threaded through said second arm member and bearing against said projection.

10. Apparatus as claimed in any one of claims 1 through 9, including a lash adjusting assembly mounted on said cylinder head, said first and second rocker arms being mounted for pivotal movement about a movable output member of said lash adjusting assembly.

11. Apparatus as claimed in claim 10, in which said movable output member is defined by an output member of a hydraulic lash adjuster mounted on said cylinder head.

12. A rocker arm assembly comprising a first arm member, a second arm member mounted for pivotal movement relative to said first arm member, biasing means acting between said first and second arm members operable to move said first arm member relative to said second arm member in a first angular direction, and means mounted on one of said first or second arm members and movable between a first position wherein it is engaged by the other of said first or second arm members to limit movement of said first arm member relative to said second arm member in a second angular direction opposite said first angular direction and a second position wherein it is not engaged by the other of said first or second arm members, characterized by means adjustably limiting the extent of relative pivotal movement between said first and second arm members in said first angular direction.

13. Apparatus as claimed in claim 12, in which said biasing means acting between said first and second arm members comprises a compression spring.

14. Apparatus as claimed in claim 13, in which said first and second arm members are pivotally mounted relative to one another to define a scissors assembly, said compression spring being received between adjacent legs of said scissors assembly.

15. Apparatus as claimed in claim 14, in which the means adjustably limiting the extent of relative pivotal movement between said first and second arm members comprises means for controlling the spacing between said adjacent legs.

16. Apparatus as claimed in claim 15, in which said means for controlling the spacing between said first and second adjacent legs comprises a threaded member acting on said first and second adjacent legs coaxially with said compression spring.

17. Apparatus as claimed in claim 16, in which said threaded member comprises a bolt received through said first and second adjacent legs with its head engaged with one of said legs and including a nut threaded onto said bolt and engaged with the other of said legs.

* * * * *